US006678540B2

(12) United States Patent
Wire et al.

(10) Patent No.: US 6,678,540 B2
(45) Date of Patent: Jan. 13, 2004

(54) TRANSMISSION LINE SINGLE FLUX QUANTUM CHIP-TO -CHIP COMMUNICATION WITH FLIP-CHIP BUMP TRANSITIONS

(75) Inventors: Michael S. Wire, Redondo Beach, CA (US); Quentin P. Herr, Torrance, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 09/935,037

(22) Filed: Aug. 22, 2001

(65) Prior Publication Data

US 2003/0040440 A1 Feb. 27, 2003

(51) Int. Cl.[7] ..... H01P 1/00; H01B 12/02

(52) U.S. Cl. ..... 505/210; 333/99 S; 333/247; 333/260; 333/33; 505/700; 505/703; 505/706

(58) Field of Search ..... 333/247, 260, 333/99 S, 33; 505/210, 700, 703, 706

(56) References Cited

U.S. PATENT DOCUMENTS 6,175,287 B1 * 1/2001 Lampen et al. ..... 333/247

FOREIGN PATENT DOCUMENTS

DE 3812662 * 10/1988 ..... 505/703

OTHER PUBLICATIONS

K.E. Yokoyama, et al., "Robust Superconducting Die Attach Process", IEEE Transactions on Applied Superconductivity, vol. 7, pp. 2631–2634 (1997).

Lynn A. Abelson, et al., "Superconductive Multi–chip Module Process for High Speed Digital Applications", IEEE Transactions on Applied Superconductivity, vol. 7, pp. 2627–2630, Jun. 1997.

Maezawa, Yamamori & Shoji, "Demonstration of Chip–to Chip propagation of sing le Flux Quantum Pulses" IEEE Transactions on Applied Super–Conductivity, vol. 11, No. 1, Mar. 2001, pp. 337–340.

* cited by examiner

*Primary Examiner*—Benny Lee
(74) *Attorney, Agent, or Firm*—Ronald M. Goldman

(57) ABSTRACT

A superconductor on-chip microstrip line (2, 4) to off-chip microstrip line (7) transition of low characteristic impedance (15, 20, 22) is realized that obtains a bandwidth of 200 GHz for MCM application while employing solder bump (15, 17) technology to connect the chips (3, 5) to the off-chip microstrip and substrate (6). Circular openings (20, 22) through the respective ground plane layers (10 & 16) of the off-chip and on-chip microstrips are provided in positions respectively underlying and overlying the solder bump (15) for the signal. The openings may be sized to provide a desired ratio of inductance to capacitance, the larger the size, the greater the ratio value. This technique may be used to match characteristic impedance to give broad bandwidth low impedance interconnections needed for direct SFQ chip-to-chip communication on a passive MCM.

10 Claims, 3 Drawing Sheets

TRANSMISSION LINE SINGLE FLUX QUANTUM CHIP-TO -CHIP COMMUNICATION WITH FLIP-CHIP BUMP TRANSITIONS

STATEMENT OF GOVERNMENT RIGHTS

This invention was made with Government support under Contract No. DMEA 90-99-D-0003 awarded by the Defense Microelectronics Activity. The government has certain rights in this invention.

FIELD OF THE INVENTION

This invention relates to superconductor multi-chip modules ("MCM") and, more particularly, to increasing the effectiveness of transmission of SFQ pulses between superconductor integrated circuits ("chips") within the module and enhancing bandwidth of the transition between the chip and the microstrip transmission line.

BACKGROUND

The most promising superconducting digital circuits communicate by transmitting Single Flux Quantum ("SFQ") pulses. The time integral of the voltage of a single flux quantum pulse is a physical constant, the flux quantum, approximately equal to 2.07 millivolt picoseconds or, in alternate terms, 2.07 milliamp picohenry. SFQ pulses are very fast and very small, having a time-integrated voltage equal to a flux quantum.

Modern superconductor digital circuits have been fabricated using integrated circuit ("IC") technology to form superconductor integrated circuits, a superconductor IC "chip". Those IC chips are designed for operation at very high speeds (i.e.,. frequencies) of 20 Gpbs, 40 Gpbs, and up to 100 Gpbs. Multiple superconductor electronic devices are typically included on a single chip. Those devices are arranged in a circuit wherein signals, SFQ pulses, are propagated from one device on the chip to other devices on the chip to produce the function intended for the circuit. The on-chip medium through which those SFQ signals propagate has been the familiar Josephson Transmission Lines ("JTL"), which, as is known, is an electronically active line formed of Josephson Junctions, the active elements of that transmission line.

More recently, on-chip SFQ pulse propagation has been extended to superconducting microstrip having impedance of between one and ten ohms and of arbitrary length. That is, superconductor microstrip lines of appropriate characteristic impedance have been integrally formed on a superconductor IC chip. Being formed of superconductors, the microstrip is loss-less, and, containing no active electronic element, is passive in nature. Thus, the microstrip line is found to provide a less technologically complex transmission media for transmission of SFQ pulses between the various circuits on a chip than a Josephson transmission line. Because the microstrip line is passive in nature, the line requires no power source to operate. Finally, signal propagation on the microstrip line approaches the speed of light, which is much faster than propagation speeds on the JTL.

As semiconductor electronic systems became more complex, it was not always feasible to include all of the functional devices for the electronic system on a single chip. Instead, the electronic systems were produced using multiple chips with appropriate signal paths between the chips. Those chips were mounted to a common passive substrate and packaged together in a module, referred to as a Multi-Chip Module ("MCM").

Similarly, the electronic circuits of superconductor digital systems are also increasing in functional complexity, and, following the lead with the prior semiconductor circuits, multiple superconductor chips were mounted on a common substrate and packaged together, defining a superconductor Multi-Chip Module. Passive transmission line, microstrip, was included to transmit a signal between individual chips in the module. Such is taught in Abelson, Elmadjian, Kerber & Smith, "Superconductive Multi-Chip Module Process for High Speed Digital Applications", *IEEE Transactions on Applied Superconductivity*, Vol. 7, No. 2, June 1997 pp 2627–2630

Further, a technology was developed and used to solder the semiconductor chips to the substrate of the MCM, referred to as "flip-chip" ball grid array, and/or mount the MCM to a circuit board, referred to as a ball grid array. An IC chip typically contains a large number of electrical interconnections that are dispersed over a flat side of the chip, forming an array of contacts for the electrical interconnections. Those electrical interconnections were difficult or impractical to solder individually. A preferred known technique for joining chips and making the electrical connections to wiring on a substrate is the flip-chip solder "ball" or, as variously termed, solder "bump" technique. In that technique solder bumps are fabricated at designated locations on the top of the chip (that correspond to locations of the solder pads on the substrate), the chip is inverted and placed on the substrate with the solder bumps aligned with corresponding solder pads on the substrate, and the solder is re-flowed by heating in an infra-red, convection, or vapor phase oven or on a hot plate to solder the chip in place on the substrate. The foregoing technique electrically and mechanically bonds the solder balls to the associated bonding pads on the circuit board, forming respective solder joints. The foregoing solder bump technique was also adopted for mounting of superconductor chips to a substrate. See Yokoyama, Akerling, Smith, and Wire, "Robust Superconducting Die Attach Process", *IEEE Transactions on Applied Superconductivity*, Vol. 7, No. 2, June 1997 pp 2631–2634 and Maezawa, Yamamori & Shoji, "Demonstration of Chip-to-Chip Propagation of Single Flux Quantum Pulses", *IEEE Transactions on Applied Superconductivity*, Vol. 11, No. 1, March 2001, pp 337–340.

The microstrip line integral to the superconductor chip may be referred to herein as the "on-chip" microstrip line. The microstrip line formed on the substrate that provides for chip to chip communication may be referred to herein as the "off-chip" microstrip line. From the foregoing publications it would appear that using solder bumps to join (and serve as the transition between) the on-chip microstrip to off-chip microstrip line is suggested as an approach to enabling chip to chip communication within a superconductor Multi-Chip Module. Yet, no one reported successfully doing so. The present applicants were also unsuccessful in using that straight forward approach to produce a practicable transition, one that could provide adequate bandwidth. The present applicants found that the solder bump connection that made the transition between the on-chip microstrip and the off-chip microstrip for low characteristic impedance produced an electrical mis-match and a narrow bandwidth.

As is known, to obtain maximum signal power transfer between different transmission lines, the characteristic impedance of the transmission lines must be the same. Ideally, that impedance is frequency independent. As an example, the on-chip and off-chip transmission lines are designed to be four (or eight) ohms in value to match the impedance of the electronic circuits on the chip. The solder bump transition used for signal passage between those lines possesses inductance, capacitance, parasitic resistance, and magnetic coupling to adjacent solder bumps. Those properties of the solder bump are of some significance at the high frequencies (and speeds) involved with superconductor circuits, a characterization that is known from the cited Maezawa publication. Irrespective of the characterization others have made of the solder bump as a transition joining the two microstrip lines, no one appears to have discovered a transition that attains large bandwidth for low characteristic impedance. A need exists to produce a solder bump coupling or transition between on-chip and off-chip microstrip lines that is impedance matched to those lines over a bandwidth of 200 GHz. As an advantage, the present invention achieves that goal.

Accordingly, an object of the invention is to improve signal transmission between separate superconductor chips.

A further object of the invention is to improve the bandwidth of the SFQ pulse transmission path used to propagate SFQ pulses between superconductor chips.

And, a still further object of the invention is to improve the matching between a superconductor integrated circuit chip that incorporates "flip-chip" solder bump technology to fasten the chip to the substrate and a microstrip transmission line located on the substrate.

SUMMARY OF THE INVENTION

In accordance with the foregoing objects and advantages, a superconductor on-chip microstrip line to off-chip microstrip line transition is realized that obtains bandwidth of 200 GHz for MCM application while employing solder bump technology to connect the superconductor chips to the off-chip microstrip line and substrate. Circular openings through the respective ground plane layers of the off-chip and on-chip microstrip lines are provided in positions respectively underlying and overlying the solder bump for the signal. In accordance with the invention, those openings may be sized to provide desired values of capacitance and inductance, it being found that the larger the size of the openings, the lesser the capacitance value and the greater the inductance. Through design and trial and error, an opening size is achieved to enable the electronic characteristics of the solder bump transition to match the characteristic impedance of the respective microstrip lines over a wide bandwidth.

The foregoing and additional objects and advantages of the invention, together with the structure characteristic thereof, which were only briefly summarized in the foregoing passages, will become more apparent to those skilled in the art upon reading the detailed description of a preferred embodiment of the invention, which follows in this specification, taken together with the illustrations thereof presented in the accompanying drawings.

DESCRIPTION OF THE PREFERRED EMBODIMENT

Figure 1:
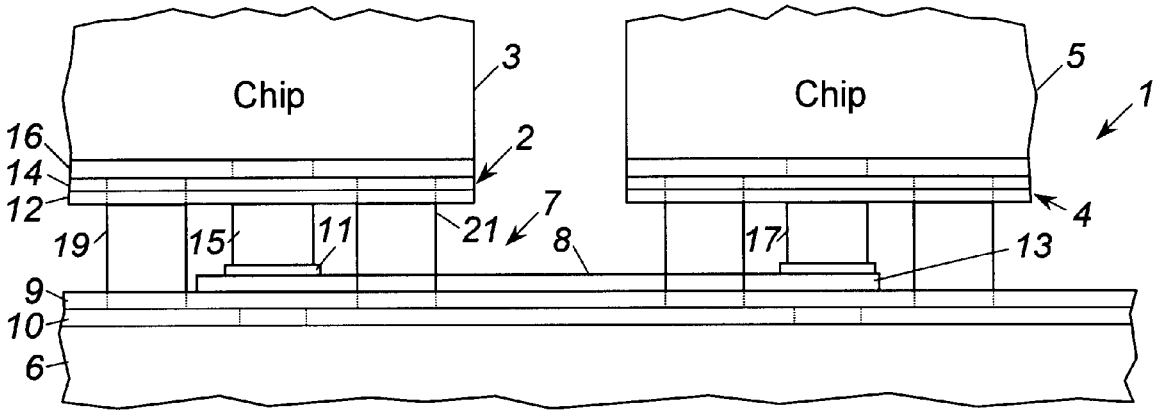
FIG. 1 is a pictorial not-to-scale side view illustration of an embodiment of a superconductor chip-to-chip transition that incorporates the solder bump-to-microstrip connection system of the invention.

Reference is made to FIG. 1, which pictorially partially illustrates an embodiment of a superconductor chip-to-chip transmission or communication system 1. The system includes a base or substrate 6 of dielectric material, suitably silicon. That substrate supports superconductor integrated circuit chips 3 and 5 and the respective microstrip lines 2 and 4 integral to the chips, a superconductor microstrip line 7 connected between the chips, and metal bonding pads 11 and 13 located, respectively, at the ends of microstrip line.

Microstrip line 7 is formed of three parts or layers, metal layer 8, called the signal layer, the dielectric layer 9 and metal layer 10, the ground plane layer. Likewise, each of the microstrip lines 2 and 4 on the chips is formed of three layers, illustrated in exaggerated scale, including metal layer 12, which is the signal layer, the dielectric layer 14, and metal layer 16, the ground layer for microstrip line 2. The three layers of microstrip line 4 are not individually numbered. Solder bumps 15 and 17 provide a mechanical and electrical connection between the signal layer of the microstrip line on chips 3 and 5, respectively, and bonding pads 11 and 13.

Solder bumps 19 and 21 provide a mechanical and electrical connection between the ground plane layer 16 of microstrip line 2 carried in chip 3 and the ground plane layer 10 of microstrip line 7. Additional "ground" bumps, like 19 and 21 are included about solder bump 15, but are not visible in this view. A like arrangement of "ground" solder bumps is included in chip 5, but are not individually numbered.

The foregoing solder bumps provide mechanical and thermal connection of the chips to the substrate as well as providing for electrical signal and ground connections. It should be appreciated that each chip contains many more solder bump connections than illustrated in FIG. 1, as example, those used to provide electrical connections for the bias voltages and signal inputs. Those additional solder bumps are soldered to corresponding solder pads, also not illustrated, supported on substrate 6. However, since those additional solder bumps and solder pads are not material to nor aid in the understanding of the invention, they need not be illustrated or described. Typically, the solder bumps are formed of indium-tin eutectic solder.

For enabling chip-to-chip signal transmission, chip 3 includes a superconductor electronic circuit, including a transmitter of SFQ pulses, and chip 5 includes superconductor electronic circuits, including a receiver of SFQ pulses. The transmitter in chip 3 outputs the SFQ pulse onto on-chip microstrip line 2. The input of the receiver in chip 5 is connected to on-chip microstrip line 4 to receive SFQ pulses applied thereto. Those electronic circuits, including transmitter and receiver, and the respective couplings thereof to the on-chip microstrip lines, internal to the respective chips are of conventional design and purpose, and are not specifically illustrated. Solder bump 15 provides the SFQ pulse signal connection from the signal layer of microstrip line 2 in chip 3 to the signal layer 8 in microstrip line 7, and solder bump 17 provides the signal connection from microstrip line 7 to the signal layer of on-chip microstrip line 4 that provides a signal path to the input of the SFQ pulse receiver internal to chip 5.

Broadly speaking, the construction visible in FIG. 1 should be recognized as known, particularly from that discussed in the earlier cited article by Maezawa, Yamamori & Shoji, entitled, "Demonstration of Chip-to-Chip Propagation of Single Flux Quantum Pulses", since the novel features to the invention are not visible or are not easily identified in this view. The output circuit of chip 3, that is, the output of the included transmitter, possesses low impedance that is characteristic of superconductor devices, which, typically, is in the zero to ten ohm range. That characteristic impedance is unlike the higher impedance that is characteristic of the ordinary transmission lines employed to connect, as example, to test equipment, such as the fifty-ohm characteristic impedance referred to in the Maezawa article. Chip-to-chip communication circuits with characteristic impedances of four and eight ohms were chosen to demonstrate this embodiment. The associated on-chip microstrip line 2 is of the same impedance by design.

Likewise, the input of the SFQ pulse receiver internal to chip 5, sometimes herein referred to as the input to chip 5, is also of the same characteristic impedance as the output of chip 3. The associated on-chip microstrip line 4 that extends to the receiver input is also of that same impedance.

Microstrip line 7, by design, also possesses of a characteristic impedance of either four ohms or eight ohms, respectively, to match the characteristic impedance of the on chip microstrip lines 2 and 4. The characteristic impedance of the foregoing microstrip lines is achieved in the microstrip line structure by using known design parameters available in the technical literature, which details are not necessary to an understanding of the invention and need not be described in detail. The solder bump connection between the on-chip microstrip line and the chip-to-chip microstrip line 7 is a discontinuity in the signal path between the chip and the microstrip line that without the invention does not match those impedances and limits the bandwidth of the transmission path.

Figure 2:
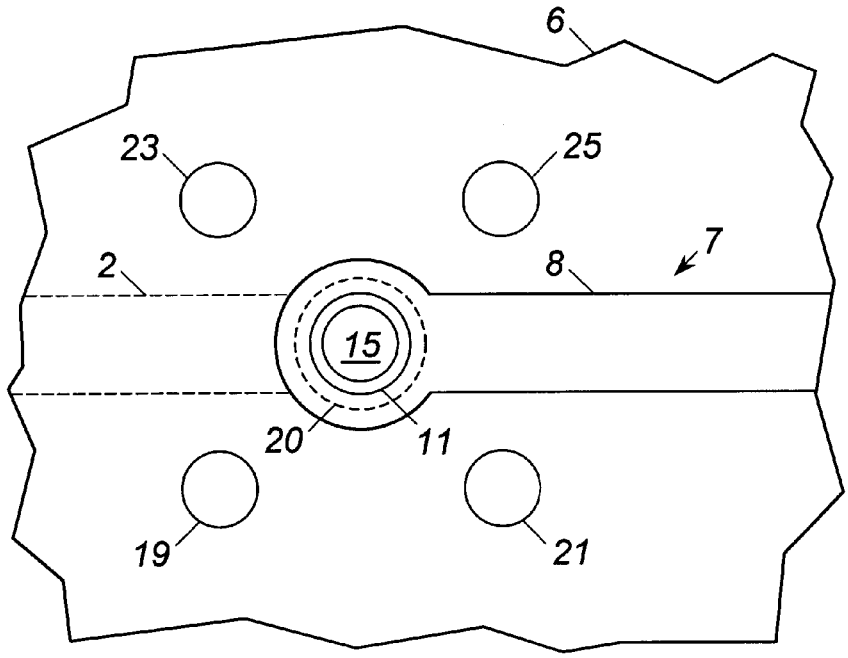
FIG. 2 is a top plan view of a portion of the solder bump-to-microstrip connection system used in the communication circuit of FIG. 1, also drawn not-to-scale and in a larger size.

FIG. 2, to which reference is made, is a top plan view of a portion of the embodiment of FIG. 1 that overlies chip 3, but in which chip 3 is omitted. Dielectric layer 9 and the metal trace 8 of strip line 7 are visible in this view. Solder bump 15, which is attached to bonding pad 11 and is in the signal path, is surrounded by four bumps or posts 19, 21, 23 and 25, the ends of which are connected to the ground plane layers of the on-chip and chip-to-chip microstrip lines 2 and 7. Those "grounded" solder bumps (and vias) essentially form a cage about solder bump 15, providing the ground return for the signal path through the latter solder bump. The on-chip microstrip line 2 is represented in phantom lines. Circle 20 shown in phantom lines represents a circular opening in the ground plane layer 10 of microstrip line 7. Ground plane layer 10 is not visible in the view, and is better illustrated in the partially exploded view of FIG. 3 to which reference is made.

Figure 3:
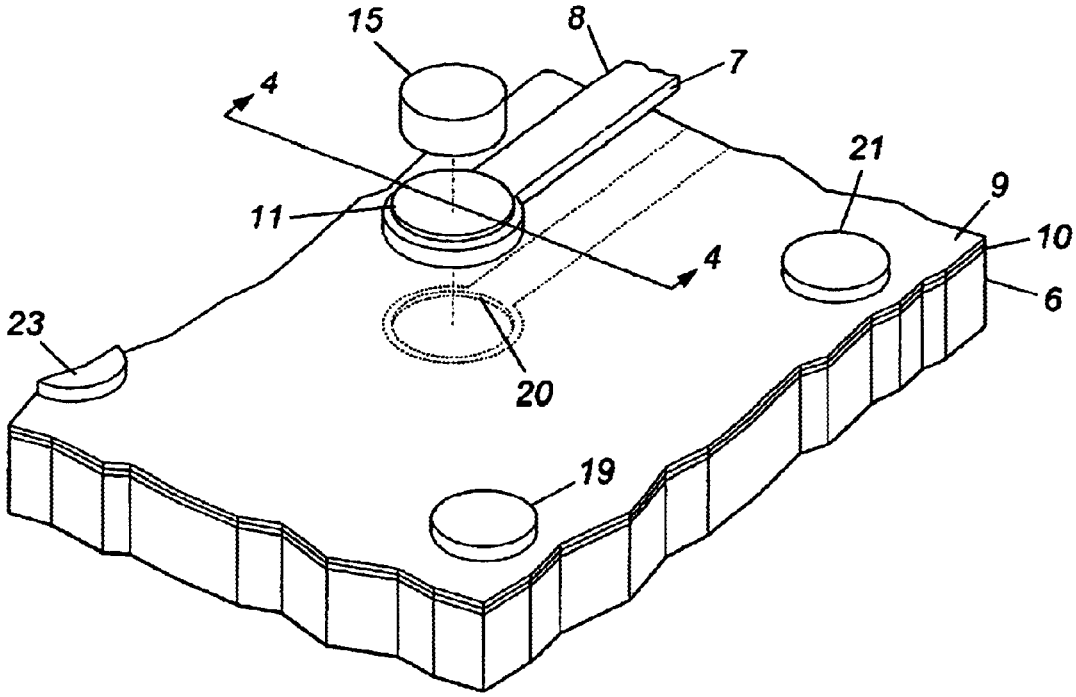
FIG. 3 is a partial exploded view of the solder bump-to-microstrip connection system of FIG. 2 in enlarged scale.

FIG. 3 is a partially exploded view of a region of FIG. 1 underlying the portion of chip containing the on-chip microstrip connection to solder bump 15 in the signal path. Substrate 6 carries the overlying ground plane layer 10 and dielectric layer 9 of microstrip line 7 cover a wide region or area. The signal layer 8 of microstrip line 7 covers a smaller area or region and is shown uplifted from the upper surface of layer 9 from the underlying position on the surface represented in dash lines. The metal solder pad 11 at the end of the line is also shown in raised position. Ground bumps or "posts" 19, 21 and 23 are partially visible. The metal of ground plane layer 10 contains a circular hole or opening 20 in the metal wall that is coaxially aligned with the circular bonding pad 11, and, hence, is well aligned with the axis of solder bump 15, underlying that bump. Circular opening 20 is filled with dielectric material, which is the same dielectric material that forms layer 9. Although not illustrated to avoid being repetitious, essentially the same structure underlies chip 5.

In the standard process of forming the microstrip, the metal ground plane layer 10 is formed on the surface of silicon substrate 6 and covers all of the surface. The ground layer 10 is subsequently patterned with a mask and etched to form the circular opening at the location that is to underlie bonding pad 11. That mask is removed, exposing the opening, and the dielectric layer is applied. The dielectric layer 9 is applied by applying the dielectric in liquid form, the composition known as BCB as example, then spinning the substrate so that the liquid material fills the hole 20 and forms a flat upper surface layer, dielectric layer 9. The liquid dielectric is then cured to harden. Effectively the foregoing forms a dielectric-filled "hole" in the metal wall.

Figure 4:
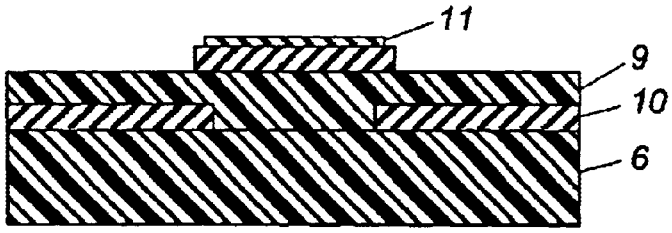
FIG. 4 is a not-to-scale partial section view of the solder bump-to-microstrip connection system of FIG. 3 as assembled.

FIG. 4 is a partial section view of FIG. 3 taken along the lines 4—4, but with the bonding pad 11 in place. As shown, the circular opening 20 (see FIG. 3) in metal layer 10, located on substrate 6, is filled with dielectric material that is integrally formed with dielectric layer 9.

Figure 5:
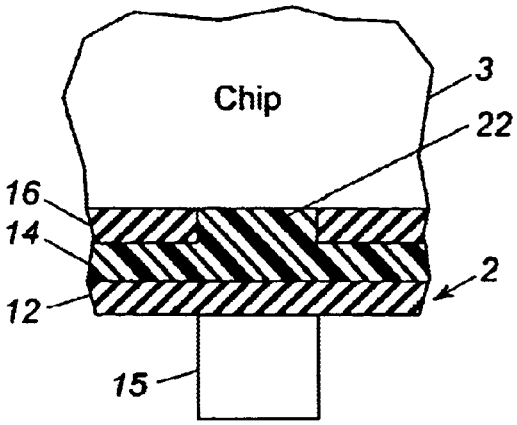
FIG. 5 is a not-to-scale pictorial side section view of a portion of chip 3 used in the embodiment of FIG. 1.

A like hole arrangement is provided on the chip side of solder bump 15. FIG. 5, to which reference is made, shows an enlarged pictorial partial section view of the region of chip 3 immediately over solder bump 15 in FIG. 1. The figure illustrates the solder bump 15 and the three layers of the on-chip microstrip line 2: metal signal layer 12, dielectric layer 14 and the metal ground plane layer 16. The annulus of a circular opening 22 is present in metal ground plane layer 16, overlying solder bump 15 and aligned coaxial therewith. That opening in the metal wall is filled with dielectric material, suitably formed of the same dielectric material as that in dielectric layer 14, and, preferably, integrally formed with the latter layer.

The layers of microstrip line 2 are formed integrally with the integrated circuit elements of chip 3, not illustrated in detail. The dielectric material in that line is, suitably, silicon dioxide ($SiO_2$), also known as silica, a hard solid. The metal layers are formed using known integrated circuit processing techniques. A difference is that the mask for defining the openings in layer 16 includes a circular one for opening 22. When the metal layer is formed, the hole mask is removed, so that the dielectric material can be later introduced therein. In the chip fabrication process the silicon dioxide is sputtered onto the assembly to form the layer. In the sputtering process the hole is filled and a surface layer is built up to a desired thickness. In practice, a depression will appear in the dielectric (and in the overlying metal layer 12) in the region overlying hole 22, but that depression is not significant and does not adversely affect the properties and electrical characteristics of the on-chip microstrip line.

The present invention stems from the recognition that the bottom and top sides of the solder bump provide metal surfaces that are spaced from metal plates, the ground plane layers, which is recognized as the basic structure of an electrical capacitor. Moreover, those spaced metal parts are separated from each other by dielectric material, which, as known, serves to increase electrical capacitance. The inclusion of a passage or opening in the metal wall on the bottom end of solder bump 15 removes a portion of the metal plate of the formed capacitance, and is found to reduce the electrical capacitance between the solder bump and ground. The removal of this ground metal also increases the inductance of the transition, but to a lesser degree. The larger the diameter (or size) of the circular opening, the lesser is the amount of capacitance. Likewise, the inclusion of the opening on the upper end of solder bump 15 removes a portion of the metal plate of the formed capacitance between the solder bump and ground. Again, the larger the diameter (or size) of the circular opening the lesser the amount of capacitance and the greater the inductance defined. To impedance match the transition to the microstrip line, the ratio of the total inductance to the total capacitance of the transition should be equal to the characteristic impedance squared, $(Z_0)^2$. By judicious tailoring of the size of the foregoing openings, hence, tailoring of the effective capacitance at each end of the solder bump, the electronic characteristics of the bump (e.g. the inductance and capacitance) can be adjusted to more closely match the impedance of the two microstrip lines over a wider range of frequencies than previously available.

Figure 6:
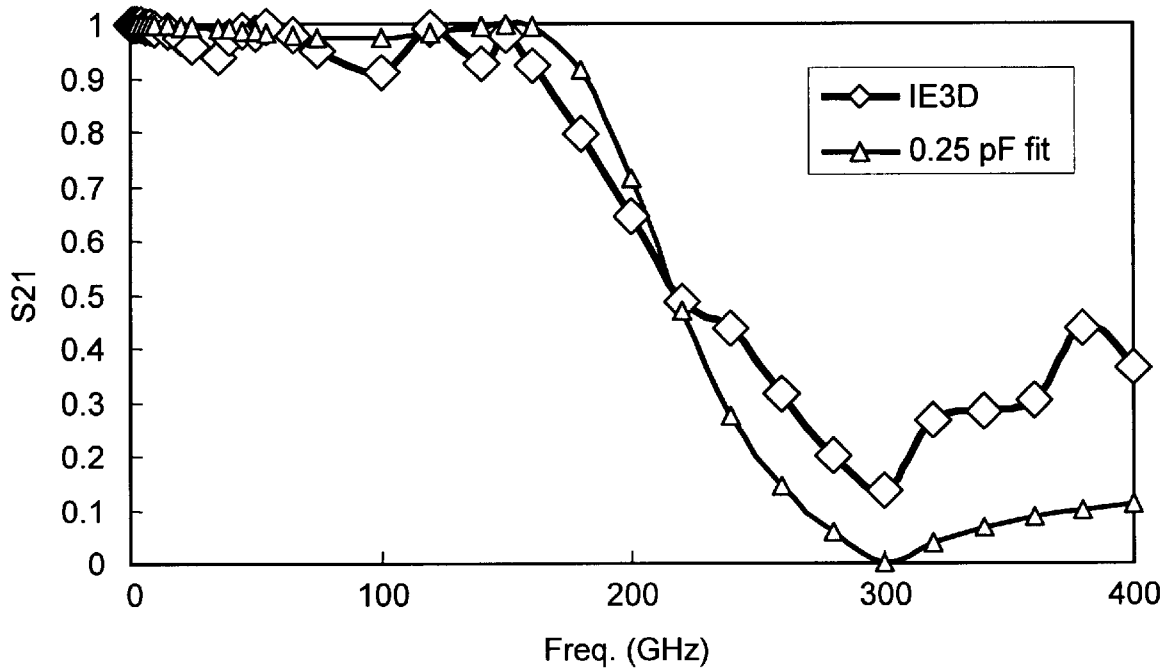
FIG. 6 is a chart illustrating the bandwidth of the connection system over a frequency range of zero to 400 GHz.

The bandwidth of a particular on-chip to off-chip microstrip transmission may be calculated fairly reliably, given the physical parameters of a specific line and transition structure, including the dimensions of the solder bump and the size of the holes in the ground plane layers and the spatial relationships, previously described, by solving Maxwell's equations for that structure. For that purpose a computer electromagnetic simulation program, "IE3D" marketed by the Zeland Software company may be used. Reference is made to FIG. 6 which provides a plot, IED3, that shows the normalized "scattering factor" of the signal level output "S21", a factor that is the square-root of the transmitted power ratio, versus frequency.

As shown in the chart, the bandwidth obtained is about 200 GHz. Beyond 200 GHz, the output falls off and reaches a null at about 300 GHz, and beyond 300 GHz the output begins to climb slightly. The reason for the null is believed to be a resonance that occurs when the distance between the signal solder bump 15 and any of the grounded bumps surrounding solder bump 15 is one quarter of the wavelength of propagation for electromagnetic waves at that frequency.

Figure 7:
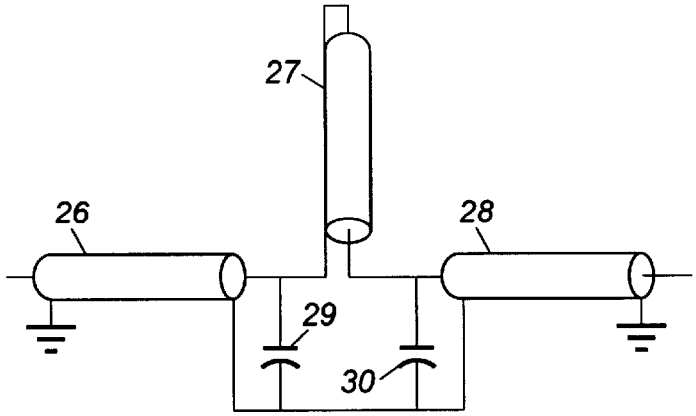
FIG. 7 illustrates an electrical equivalent circuit of the solder bump-to-microstrip connection system of FIGS. 2–4, derived from FIG. 6.

Although application of Maxwell's equation adequately electronically characterizes a specific embodiment of the transition structure as in FIG. 6, superconductor circuit design requires a different form of the information. Computer programs that assist the circuit designer to design a complete circuit by simulating results, such as the WRSpice program marketed by Whiteley Research company, requires that the design be entered into the program in the form of an electrical equivalent circuit. FIG. 7 illustrates an electrical equivalent circuit of solder bump 15 in the microstrip to microstrip connection (or, as variously termed transition) of FIG. 1 that was derived to characterize the transition based on the curve "IE3D" obtained in FIG. 6.

That equivalent circuit includes three transmission lines 26, 27 and 28, whose characteristic impedance matches the characteristic impedance of the microstrip lines. The circuit also includes capacitors 29 and 30. Transmission line 26 contributes a time delay to an inputted SFQ pulse. That pulse is fed into capacitor 29 and also fed through coaxial line 27, which contributes a second time delay, and then into capacitance 20 and transmission line 28 which also contributes a time delay.

In a specific example, the characteristic impedance of the microstrip lines 2 and 7 was four ohms as was characteristic impedance of equivalent transmission lines 26 and 28. Transmission lines 26 and 28 introduced a time delay of 2.2 psec. Transmission line 27 had a characteristic impedance of 3.5 ohms and introduced a time delay of 0.82 psec. And capacitors 29 and 30 were selected to have a capacitance of 0.25 pF. It should be noted that capacitors 29 and 30 do not directly correspond to the capacitance between the solder bump 15 and the respective ground layers of the two microstrip lines 2 and 7, but to the excess of capacitance in the solder bump transition. That is the solder bump transition possesses both inductance and capacitance. The transmission line 27 has some inductance, capacitance, and time delay. All the inductance and time delay needed to fit the IE3D data to the model is contributed by transmission line 27. Additional capacitance beyond what is contributed by transmission line 27 is required to fit the IE3D data. This additional capacitance is split in half and substituted in the equivalent circuit as capacitors 29 and 30.

With the foregoing values the scattering factor of the signal transmission is calculated and plotted against frequency. The result is graphically plotted as the second curve, 0.25 pF Fit, which is presented in FIG. 6 to which reference is again made. As shown, the power curve obtained through use of the equivalent circuit closely approximates that obtained through use of Maxwell's equations. As a result, the proposed equivalent circuit is verified, and the equivalent circuit of the solder bump transition may be used for circuit design purposes.

In a practical embodiment, the metal used for the metal of the microstrip lines is niobium, a refractory metal, which transitions to a superconducting state at a temperature of 9.2 Kelvin. The dielectric layers of those lines were silicon dioxide for the chip and benzocyclobutene ("BCB") for the MCM substrate. The solder bump was of indium-tin eutectic solder, the solder pad region consisted of a thin titanium adhesion layer, a thicker palladium layer that was wetable by the solder, and a thin layer of gold to prevent oxidation before soldering. The size of the dielectric filled passage in the ground layer of the off-chip microstrip was one micron thick and 96 or 110 microns in diameter for the four and eight ohm cases, respectively, and that of the dielectric filled passage in the ground layer of the on-chip microstrip was two hundred nanometers thick and 109 or 117 microns in diameter for the four and eight ohm cases, respectively, and the size of the solder bumps were six microns high and one hundred microns in diameter.

Although the terminology used in this specification is understood by those skilled in the superconductor field or has been implicitly defined, some additional definitions may be helpful to the less skilled reader. The term "propagation" or "transmission" as used herein refers to the movement of an electrical flux quantum pulse along a line. As used herein "chip" means a superconductor integrated circuit chip, "receiver" means a superconductor receiver circuit, an electronically operated circuit that for operation relies upon the phenomenon of superconductivity of metals, and the Josephson Junction. The term "transmitter" means a superconductor transmitter circuit, an electronically operated circuit that for operation also relies upon the foregoing phenomenon and junction.

It is believed that the foregoing description of the preferred embodiments of the invention is sufficient in detail to enable one skilled in the art to make and use the invention without undue experimentation. However, it is expressly understood that the detail of the elements comprising the embodiment presented for the foregoing purpose is not intended to limit the scope of the invention in any way, in as much as equivalents to those elements and other modifications thereof, all of which come within the scope of the invention, will become apparent to those skilled in the art upon reading this specification. Thus, the invention is to be broadly construed within the full scope of the appended claims.

What is claimed is:

1. A superconductor on-chip microstrip line-to-off-chip microstrip line transition, said on-chip microstrip line, including a metal signal line, a layer of dielectric material and a metal ground plane layer and said off-chip microstrip line, including a metal signal line, a layer of dielectric material and a metal ground plane layer, comprising:

a solder bump, said solder bump having one end thereof connected to said metal signal line of said on-chip microstrip line and having an opposite end thereof connected to said metal signal line of said off-chip microstrip line;

said metal ground plane layer of said on-chip microstrip line including: an opening defining a non-metallic passage therethrough, said passage thereof being filled with dielectric material;

said metal ground plane layer of said off-chip microstrip line including: an opening defining a non-metallic passage therethrough, said passage thereof being filled with dielectric material; and said non-metallic passage in said ground plane layer of said on-chip microstrip line overlying said one end of said solder bump and said non-metallic passage in said ground plane layer of said off-chip microstrip line underlying said opposite end of said solder bump.

2. The transition as defined in claim 1, wherein said solder bump, said non-metallic passage in each of said metal around Diane layers of said on-chip microstrip line and said off-chip microstrip line comprise a circular cross-section.

3. The transition as defined in claim 2, wherein said non-metallic passages in each of said metal around plane layers of said on-chip microstrip line and said off-chip microstrip line and said solder bump are in coaxial alignment.

4. The transition as defined in claim 3, wherein said dielectric material filling said non-metallic passage in said metal around Diane layer of said off-chip microstrip line is integral with said dielectric layer of said off-chip microstrip line.

5. The transition as defined in claim 2 wherein said non-metallic passage in said metal around plane layers of each of said on-chip microstrip line and said off-chip microstrip line is of a cylindrical geometry.

6. The transition as defined in claim 1, wherein said dielectric material filling said non-metallic passage in said metal around plane layer of said on-chip microstrip line is integral with said dielectric layer of said on-chip microstrip line.

7. The transition as defined in claim 1, wherein said opening in said metal around plane layer of said off-chip microstrip line is circular in geometry.

8. A superconductor on-chip microstrip line-to-off-chip microstrip line transition, said on-chip microstrip line, including a metal signal line, a layer of dielectric material and a metal ground plane layer and said off-chip microstrip line, including a metal signal line, a layer of dielectric material and a metal ground plane layer, comprising:

a solder bump, said solder bump having one end thereof connected to said metal signal line of said on-chip microstrip line and having an opposite end thereof connected to said metal signal line of said off-chip microstrip line;

said metal ground plane layer of said on-chip microstrip line including: an opening there through, said opening being filled with electrical insulating material;

said metal ground plane layer of said off-chip microstrip line including: an opening there through, said opening being filled with electrical insulating material; and said one end of said solder bump being positioned underlying said opening in said ground plane layer of said on-chip microstrip line and said opposite end of said solder bump being positioned overlying said opening in said ground plane layer of said off-chip microstrip line.

9. A superconductor chip to chip communication system comprising:

a first chip, said first chip including a first microstrip line;

said first microstrip line including a metal signal line, a layer of dielectric material and a metal ground plane layer;

a second chip, said second chip including a second microstrip line;

said second microstrip line including a metal signal line, a layer of dielectric material and a metal ground plane layer;

a substrate of dielectric material;

a third microstrip line carried on said substrate;

said third microstrip line, including a metal signal line, a layer of dielectric material and a metal ground plane layer, a first solder bump having one end connected to said signal layer of said first microstrip and a second end connected to said signal layer of said third microstrip;

a second solder bump having one end connected to said signal layer of said second microstrip and a second end connected to said signal layer of said third microstrip;

said metal ground plane layer of said first microstrip line including: an opening defining a non-metallic passage through said metal ground plane layer, said opening being filled with dielectric material, said opening located overlying said first solder bump;

said metal ground plane layer of said second microstrip line including: an opening defining a non-metallic passage through said metal ground plane layer, said opening being filled with dielectric material, said opening located overlying said second solder bump;

said metal ground plane layer of said third microstrip line including first and second openings defining first and second non-metallic passages through said ground plane layer of said third microstrip line, said first and second openings being spaced apart and being filled with dielectric material;

said first opening of said third microstrip line underlying said first solder bump and said second opening of said third microstrip line underlying said second solder bump respectively;

third and fourth solder bumps;

said third solder bump positioned adjacent said first solder bump and said fourth solder bump positioned adjacent said second solder bump;

said third solder bump being connected between said ground plane layer of said first microstrip line and said ground plane layer of said third microstrip line; and said fourth solder bump being connected between said ground plane layer of said second microstrip line and said ground plane layer of said third microstrip line.

10. A superconductor multi-chip module including a superconductor chip-to-chip communication circuit, said circuit including an a first superconductor integrated circuit chip for transmitting digital signals to a second superconductor integrated circuit chip over a transmission line;

said second superconductor integrated circuit chip for receiving digital signals from said first superconductor integrated circuit chip;

said first and second superconductor integrated circuit chips including a plurality of solder bumps on a side thereof;

a substrate;

said substrate, including:

a layer of insulating material overlying a layer of superconductor metal;

a microstrip transmission line defining said transmission line, said microstrip transmission line having a characteristic impedance of H-ohms; and a plurality of bonding pads on said surface of said substrate;

one of said solder bumps being connected to an output of said first integrated circuit chin and another of said solder bumps being connected to a circuit ground of said first integrated circuit chip;

a first of said plurality of bonding pads being connected in circuit with said microstrip transmission line at one location on said transmission line, and a second of said plurality of bonding pads being connected in circuit with said microstrip transmission line at another location on said transmission line;

third, fourth, fifth and sixth bonding pads positioned about said first bonding pad equidistant therefrom and from one another, each of said third, fourth, fifth and sixth bonding pads being electrically connected to said metal layer of said substrate;

said one of said plurality of solder bumps of said first integrated circuit chip being soldered to said first of said plurality of bonding pads and said other ones of said plurality solder bumps being fused to corresponding ones of said third through sixth bonding pads to attach said first integrated circuit chip to said substrate;

said one solder bump defining a transition between said output of said first integrated circuit chip and said microstrip transmission line;

said superconducting metal layer of said substrate including a circular passage of a predetermined diameter D there through, said circular passage being located coaxial with said first bonding pad and being electromagnetically linked to said one solder bump, wherein the diameter of said circular passage influences the value of said characteristic impedance of said transition;

said diameter D of said circular passage being such as to produce an influence on said transition that forces said characteristic impedance of said transition to H-ohms, whereby said characteristic impedance of said transition is matched to said characteristic impedance of said transmission line.

* * * * *